United States Patent [19]

Harootian, Jr. et al.

[11] Patent Number: 4,757,920

[45] Date of Patent: Jul. 19, 1988

[54] REFRIGERATED DISPENSER FOR BEVERAGES

[76] Inventors: Simon G. Harootian, Jr., 12 Rollingwood Dr.; Barry Krock, 300 Salisbury St., both of Worcester, Mass. 01609

[21] Appl. No.: 5,261

[22] Filed: Jan. 20, 1987

[51] Int. Cl.[4] ..... B67D 5/62

[52] U.S. Cl. ..... 222/146.6; 222/183; 62/394; 220/4 B

[58] Field of Search ..... 222/146.6, 129.1, 129, 222/146.1, 182, 183; 62/394, 395; 220/4 E, 4 B; 312/228, 229, 209

[56] References Cited

U.S. PATENT DOCUMENTS

| | | | |
|---|---|---|---|
| 3,325,058 | 6/1967 | West, Jr. | 222/183 |
| 3,435,990 | 4/1969 | Pike, Jr. | 222/94 |
| 3,451,580 | 6/1969 | Husby | 220/4 B |
| 4,071,160 | 1/1978 | Vick | 220/4 B |

*Primary Examiner*—H. Grant Skaggs
*Assistant Examiner*—Kenneth Noland
*Attorney, Agent, or Firm*—Salter & Michaelson

[57] ABSTRACT

A refrigerated dispenser for beverages includes a housing, a solid state cooling assembly in the housing, a container member which is receivable in the housing and a discharge assembly including a neck portion which extends outwardly from the container member and a valve on the neck portion. The housing comprises first and second housing sections including peripheral edge portions having opposed open notches therein, and the housing sections are movable between an open position wherein the peripheral edge portions are separated and a closed position wherein the peripheral edge portions are received in mating relation, and the notches define an aperture in the housing. The container member and the discharge assembly are receivable in the housing so that when the housing sections are in the closed positions thereof, the neck portion extends through the aperture and the valve is disposed on the exterior of the housing so that it can be manipulated for discharging a beverage from the container member.

1 Claim, 3 Drawing Sheets

REFRIGERATED DISPENSER FOR BEVERAGES

BACKGROUND AND SUMMARY OF THE INVENTION

The instant invention relates to dispensing apparatus for beverages and more particularly to a refrigerated dispenser for containerized beverages, such as bottled water.

In many geographical areas the quality of the water which is available for household use has deteriorated significantly in recent years. In fact, in some geographical areas, much of the water which is available for household use from household wells and/or local water systems has become polluted to the extent that for public health reasons it is unacceptable for use as drinking water. Further, in many other geographical areas water which is acceptable for drinking purposes from a public health standpoint has offensive odors and/or tastes which make it nevertheless undesirable for use as drinking water. For these reasons, the use of bottled spring water for drinking purposes has become increasingly popular in many areas.

Unfortunately, however, while the use of bottled spring water has been found to have substantial advantages from the standpoint of providing an effective source of high quality drinking water, it has been found that it nevertheless has some practical disadvantages. For example, it has been found that in order to make residential usage of bottled spring water practical, water must generally be purchased in relatively large containers containing several gallons or more of water. Preferably, containers of this type have discharge nozzle asemblies thereon, and they are generally adapted to be supported on surfaces such as counter tops or table tops. However, containers containing several gallons or more of water are inherently relatively heavy and cumbersome, and they are inherently so large that it is normally impractical to store them in household refrigerators despite the fact that it is desirable to maintain drinking water at chilled temperatures.

Accordingly, as a result of the increased residential usage of bottled water, a need has developed for an effective refrigerated apparatus which can be utilized for dispensing bottled water for household use. More specifically, a need has developed for an effective beverage dispenser which is operable for receiving a container or bottled water therein and for dispensing water from the container, wherein the dispenser is adapted to be operated and stored in an area such as on a counter top area of a household kitchen. Further, a still more specific need has developed for a refrigerated dispenser apparatus for beverages, which is operable in combination with a container of a type having a discharge assembly preassembled therewith, wherein the discharge assembly is manipulatable from the exterior of the dispenser apparatus for dispensing a beverage from the container.

Devices representing the closest prior art to the subject invention of which the applicant is aware are disclosed in the U.S. Pat. Nos. to CASADY, 3,233,817; GRAN, 3,237,810; PIKE, JR., 3,435,990; TAYLOR, 3,811,294; EDWARDS et al, 4,174,051; SHIRLEY, 4,304,341; REED et al, 4,311,017 and DONNELY, 4,320,626. Of the devices disclosed in these references, only those disclosed in the U.S. patents to PIKE, JR. and SHIRLEY include containers having discharge assemblies preassembled therewith, wherein the containers are receivable in refrigerated housings so that the discharge assemblies thereof extend outwardly from the housings and are manipulatable from the respective exteriors thereof. However, as will hereinafter be made apparent, even these references fail to suggest the novel and advantageous structural features of the dispenser of the subject invention, and hence they are believed to be of only general interest with regard to the subject invention.

The instant invention provides a novel refrigerated dispenser which is highly effective for dispensing beverages, such as bottled water and which is practical for household applications. Specifically, the refrigerated dispenser of the instant invention comprises a substantially rigid container member which is preferably made in a molded plastic construction and discharge means communicating with the interior of the container member for discharging a beverage therefrom, the discharge means including a neck portion extending outwardly from the container member and valve means on the neck portion in outwardly spaced relation to the container member for discharging the beverage therefrom. The dispenser further comprises a thermally insulated housing which is adapted for receiving the container member therein and electrical cooling means communicating with the container member when it is received in the housing for cooling a beverage contained therein. The housing comprises first and second housing sections which include peripheral edge portions having opposed substantially aligned open notches formed therein and which are alternatively positionable in open and closed positions to define open and closed positions of the housing, respectively. The housing is constructed so that when it is in the open position thereof, the peripheral edge portions of the housing sections are separated from each other to form an access opening for receiving the container member in the housing and so that when the housing is in the closed position thereof, the peripheral edge portions of the housing sections are received in substantially mating relation, and the notches cooperate to define an aperture in the housing. The notches are preferably formed so that when the housing is in the closed position thereof, the dimension of the aperture formed by the notches is only slightly greater than the sectional dimension of the neck portion of the discharge means on the container member. Further, the housing is preferably adapted for snugly receiving the container member therein in a position wherein the neck portion of the discharge means is received in the aperture, and the valve means is disposed on the exterior of the housing. Further, the cooling means preferably comprises solid state electrical cooling means including a cold side heat exchanger, and the container member is preferably adapted to be received in the housing so that it is in intimate thermal communication with the cold side heat exchanger. In one embodiment of the dispenser of the instant invention, the first and second housing sections include lower and upper front wall portions, respectively, in which the notches are formed; and the upper front wall portion is moved upwardly and away from the lower front wall portion as the housing is moved to the open position thereof. In another embodiment of the dispenser, the housing sections include first and second front wall portions which have the notches formed therein and which define opposite side portions of a front wall, and the front wall portions are hinged outwardly with respect to each other as the housing is moved to the open position thereof.

Accordingly, it is a primary object of the instant invention to provide a practical and effective refrigerated device for dispensing a containerized beverage such as bottled water.

Another object of the instant invention is to provide a refrigerated dispenser for bottled water which is practical for household use.

An even further object of the instant invention is to provide a refrigerated beverage dispenser comprising a refrigerated housing and a container having a discharge assembly thereon wherein the container is receivable in the housing so that the discharge assembly extends through an aperture in the housing and is manipulatable from the exterior of the housing for dispensing a beverage from the container.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
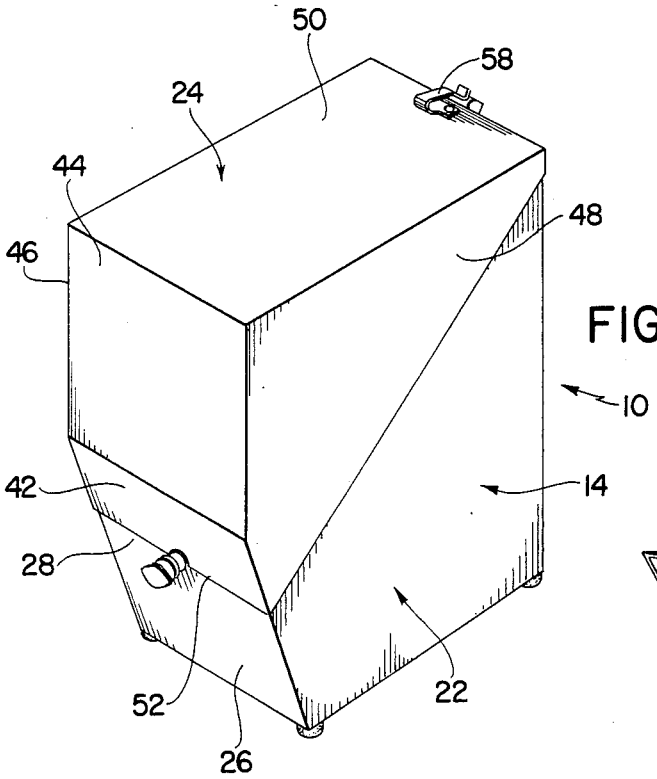
FIG. 1 is a perspective view of a first embodiment of the dispenser of the instant invention with the housing in the closed position.
Figure 2:
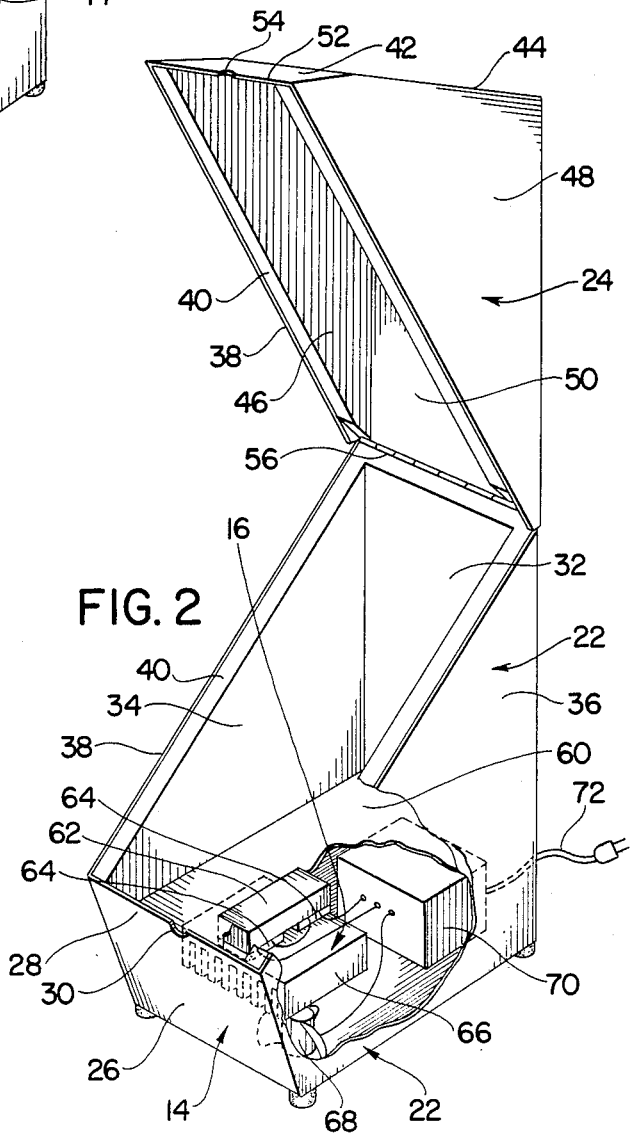
FIG. 2 is a perspective view of the housing in the open position with portions broken away to illustrate the cooling assembly.
Figure 3:
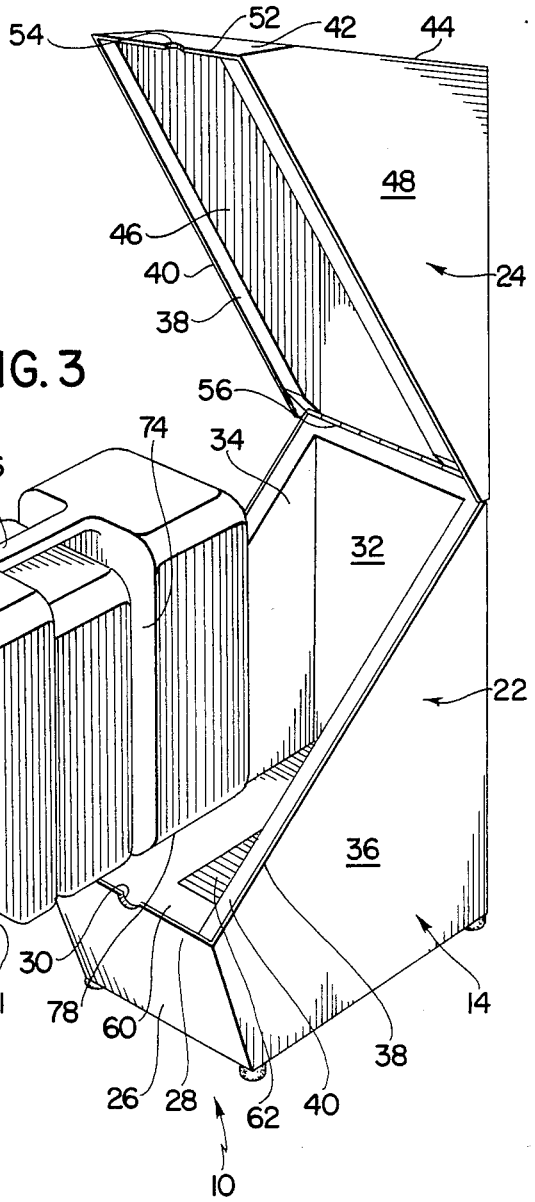
FIG. 3 is a perspective view of the dispenser with the housing in the open position thereof and the container member partially received in the housing.
Figure 4:
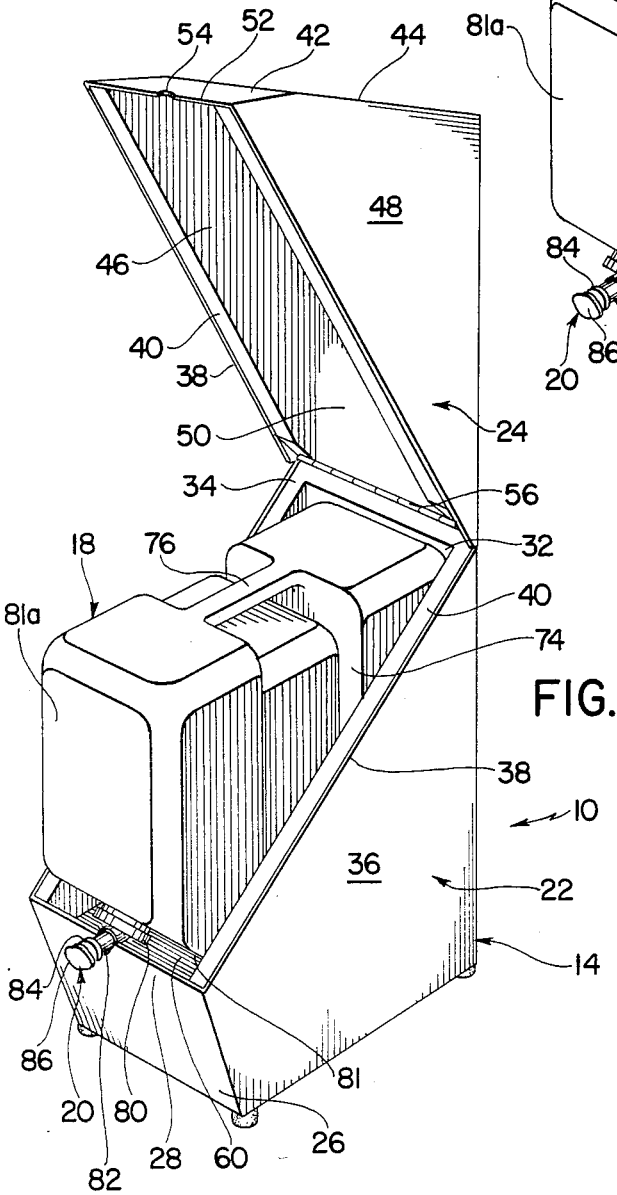
FIG. 4 is a perspective view of the dispenser with the housing in the open position thereof and the container received in the housing.
Figure 5:
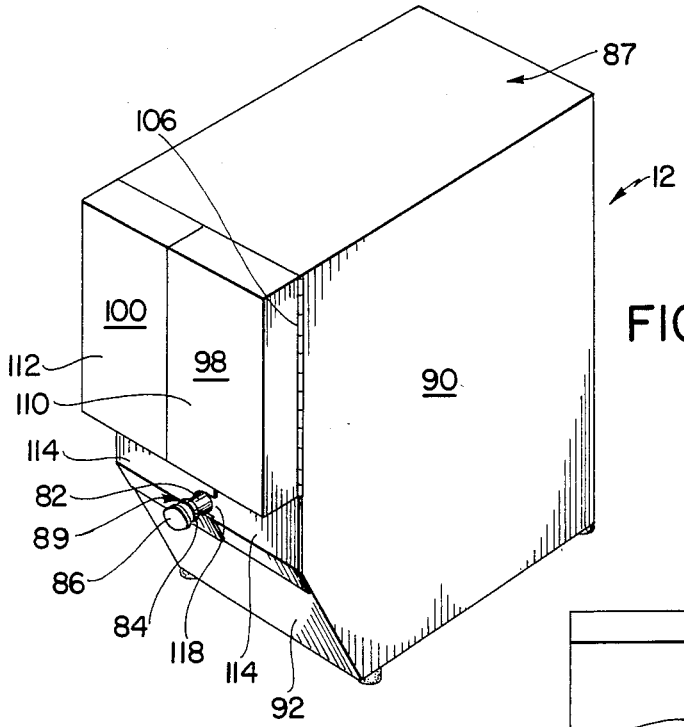
FIG. 5 is a perspective view of a second embodiment of the dispenser with the housing in the closed position.
Figure 6:
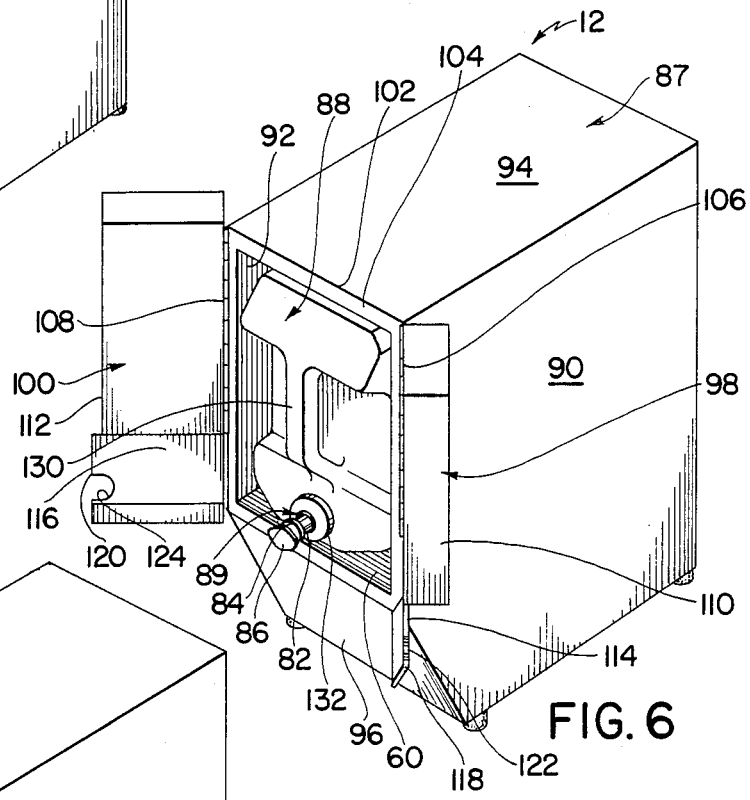
FIG. 6 is a perspective view thereof with the housing in the open position.
Figure 7:
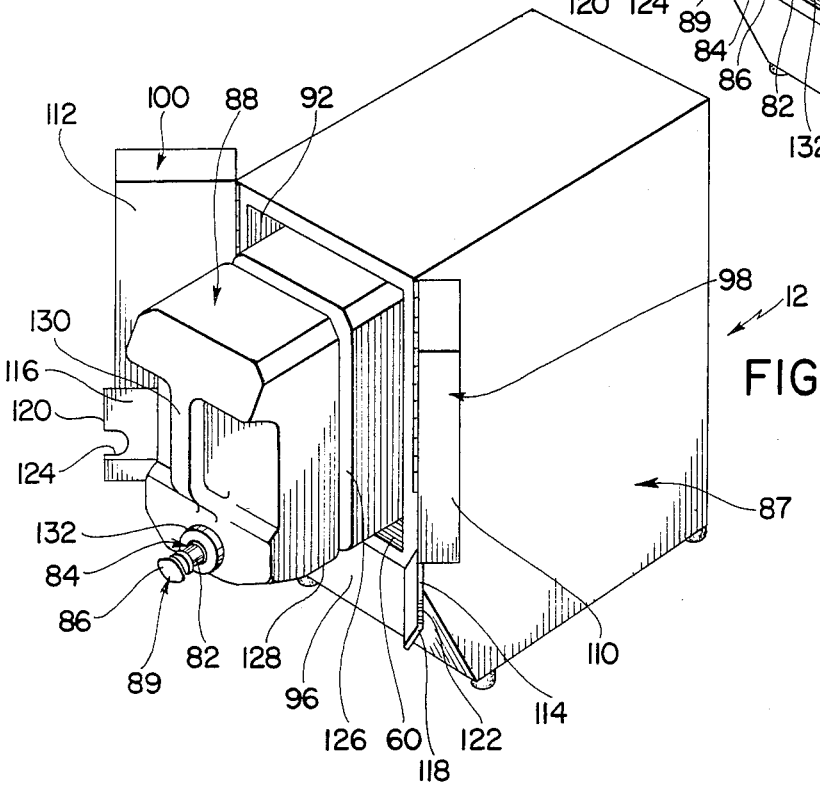
FIG. 7 is a perspective view thereof with the container partially received in the housing.

Referring now to the drawings, a first embodiment of the dispenser of the instant invention is illustrated in FIGS. 1–4 and generally indicated at 10 in FIGS. 1, 3 and 4; and a second embodiment of the dispenser is illustrated and generally indicated at 12 in FIGS. 5–7. The dispensers 10 and 12 are operative for dispensing beverages such as drinking water from prefilled containers having discharge mechanisms thereon, and they are particularly adapted for use in household applications.

The dispenser 10 comprises a housing generally indicated at 14, a cooling assembly generally indicated at 16 mounted in the housing 14, a container member generally indicated at 18 which is receivable in the housing 14, and a discharge mechanism generally indicated at 20 which is attached to the container member 18 and operative for discharging a liquid, such as water from the container member 18. The container member 18 is receivable in the housing 14 so that a portion of the discharge mechanism 20 extends outwardly through the housing 14 and is manipulatable from the exterior of the housing 14 for dispensing a beverage, such as water from the container member 18 as will hereinafter be more fully set forth.

The housing 14 preferably comprises first and second housing sections generally indicated at 22 and 24, respectively, which are hingeably connected so that they are movable between the open position of the housing illustrated in FIGS. 2–4 and the closed position thereof illustrated in FIG. 1. As will be seen, the first and second housing sections 22 and 24, respectively, define lower and upper portions of the housing 14, respectively, and they are hingeably connected so that when the housing 14 is in the closed position thereof they cooperate to define a substantially enclosed chamber for containing the container member 18 therein and so that when the housing 14 is in the open position thereof the second housing section 24 is hinged upwardly with respect to the first housing section 22 to provide access to the interior of the housing 14. The first housing section 22 includes a lower front wall portion 26 having an upper peripheral edge portion 28 in which a notch 30 is formed, a rear wall 32 and a pair of spaced lower side wall portions 34 and 36. As will be seen, the lower front wall portion 26, the lower side wall portions 34 and 36, and the rear wall 32 cooperate to define an open box-like structure having a rearwardly increasing height wherein the upper extremities of the side wall portions 34 and 36 extend angularly upwardly from the lower front wall portion 26 to the rear wall 32. The lower front wall portion 26, the lower side wall portions 34 and 36, and the rear wall 32 preferably comprise an outer shell 38 made from a structurally rigid material, such as aluminum or a suitable plastic, and the lower side wall portions 34 and 36 and the rear wall 32 preferably include an inner insulating layer 40 made from an insulating material such as styrofoam. The second or upper housing section 24 comprises intermediate and upper front wall portions 42 and 44, respectively, a pair of spaced upper side wall portions 46 and 48, respectively, and a top wall 50. The intermediate and upper front wall portions 42 and 44 cooperate with the lower front wall portion 26 for defining a front wall of the housing 14 when the housing 14 is in the closed position thereof, and the intermediate front wall portion 42 includes a peripheral edge portion 52 having a notch 54 formed therein, which is aligned with the notch 30 when the housing 14 is in the closed position. The front wall portions 42 and 44, the sidewall portions 46 and 48, and the top wall 50 preferably comprise an outer shell 38 made of a structurally rigid material such as aluminum, and the front wall portion 44, the side wall portions 46 and 48 and the top wall 50 preferably further comprise an insulating layer 40. The upper housing section 24 is formed in a generally complimentary configuration to the lower housing section 22, and it is hingeably attached to the lower housing section 22 adjacent the upper extremity of rear wall 32 with a hinge 56. Attached to the lower and upper housing sections 22 and 24, respectively, adjacent the hinge 56 is a counter balance spring assembly 58 which is operative for counter balancing the weight of the upper housing section 24 as it is hinged upwardly. The first and second housing sections 22 and 24, respectively, are hingeably connected with the hinge 56 so that when the housing 14 is in the closed position thereof, the peripheral edge portions 28 and 52 are received in substantially mating relation, and the notches 30 cooperate to define an aperture in the front wall of the housing 14.

The cooling assembly 16 is illustrated most clearly in FIG. 2, and it is mounted in the lower housing section 22. The cooling assembly 16 comprises a conventional solid state cooling apparatus and it includes a cold plate 60 which is mounted in the housing section 22 and a cold side heat exchanger 62 which is mounted in the center of the cold plate 60 so that it cooperates therewith to define a bottom wall of the interior of the housing section 22. The cooling assembly 16 further comprises a pair of thermoelectric cooling modules 64 which are mounted in intimate engagement with the exchanger 62, a hot side heat exchanger 66 which is mounted on the undersides of the modules 64, a fan 68 and a power supply 70. The power supply 70 includes a power cord 72 which is receivable in an electrical outlet for supplying electrical current to the cooling assembly 16, and it is operative for energizing the thermoelectric modules 64 for cooling the cold side heat exchanger 62 and the cold plate 60 while simultaneously producing heat from the hot side exchanger 66. The fan 68 is operative for dissipating the heat produced from the hot side exchanger 66 in a conventional manner.

The container member 18 preferably comprises a molded plastic container which is dimensioned for containing between approximately 2 and 5 gallons of water. The container member 18 is preferably of substantially rectangular sectional configuration, and it includes stiffening ribs 74, a handle 76, a generally flat bottom wall 78 and a mouth 80. The container member 18 further comprises a dispensing wall 81 which extends angularly upwardly and forwardly from the bottom wall 78, and a front wall **81*a* which extends upwardly from the dispensing wall 81 in substantially perpendicular relation to the bottom wall 78. The container member 18 and the housing 14 are preferably dimensioned so that the container member 18 is snugly receivable in the housing 14 so that the bottom wall 78 is supported on the cold plate 60 and the exchanger 62 and so that when the housing 14 is in the closed position thereof, the discharge mechanism 20 extends through the aperture defined by the notches 30 and 54. When the container member 18 is received in the housing 14 in this manner, the dispensing wall 18 is disposed adjacent the lower front wall portion 26 of the housing 14, and when the housing 14 is in the closed position thereof, the intersection between the intermediate front wall portion 42 and the upper front wall portion 44 is disposed adjacent the intersection between the dispensing wall 81 and the front wall 81*a* of the container member 18**.

The discharge mechanism 20 is preferably of conventional construction, and it includes a tubular neck portion 82 which extends outwardly from the mouth 80 and a valve portion 84 which is attached to the neck portion 82 in outwardly spaced relation to the mouth 80. The valve portion 84 includes a terminal end portion 86 which is outwardly movable a slight distance relative to the remainder of the valve portion 84 to operate the valve portion 84 in an open position for discharging liquid from the container member 18, and which is thereafter inwardly depressible for terminating the discharge of liquid from the container member 18.

For use of the dispenser 10, the upper second housing section 24 is hinged upwardly to move the housing 14 to the open position thereof, and a container member 18 containing a quantity of a liquid, such as spring water is placed in the lower first housing section 22 so that the bottom wall 78 of the container member 18 is supported on the cold plate 60 and the exchanger 62 and so that the neck portion 82 is received in the notch 30. Thereafter, the upper second housing section 24 is hinged downwardly so that the peripheral edge portions 28 and 52 meet in substantially mating relation and so that the notches 30 and 54 meet in substantially aligned opposed relation and cooperate to define an aperture in the lower front wall portion of the housing 14. The electrical cord 72 is then connected to an electrical outlet to energize the cooling assembly 16 for cooling the liquid contained in the container member 18; and once the liquid in the container member 18 has been chilled by the cooling assembly 16, the chilled liquid can be dispensed from the apparatus 10 by manipulating the valve portion 84.

Referring now to FIGS. 5–7, the dispenser 12 is illustrated. The dispenser 12 comprises a housing generally indicated at 97, a container member generally indicated at 88, a discharge mechanism 89 on the container member 88, and a cooling assembly (not shown) in the housing 87.

The housing 87 comprises a pair of spaced sidewalls 90 and 92, respectively, a top wall 94, a rear wall (not shown), a lower front wall portion 96 and a pair of doors 98 and 100 which cooperate with the lower front wall portion 96 for defining a front wall of the housing 87. The sidewalls 90 and 92, the top wall 94, the rear wall (not shown), and the lower front wall portion 96, preferably comprise an outer shell 102 which is made of a structurally rigid material, such as aluminum or a suitable plastic, and the sidewalls 90 and 92, the top wall 94 and the rear wall (not shown), preferably further comprise an insulating layer 104 made of an insulating material, such as styrofoam. The doors 98 and 100 are hingeably attached to the forward extremities of the sidewalls 90 and 92 with hinges 106 and 108, respectively, and they include upper portions 110 and 112, respectively, and lower portions 114 and 116, respectively. The upper portions 110 and 112 and the lower portions 114 and 116 are preferably made of a suitable structurally rigid material such as aluminum or a suitable plastic, and the upper portions 110 and 112 are preferably made in insulated constructions. The lower portions 114 and 116 include peripheral edge portions 118 and 120, respectively, having open notches 122 and 124, respectively, therein. The doors 98 and 100 are constructed so that when they are in the closed positions thereof illustrated in FIG. 5, the upper portions 110 and 112 meet in substantially mating relation, and the lower portions 114 and 116 also meet in substantially mating relation. In this regard, the lower portions 114 and 116 are constructed so that when the doors 98 and 100 are in the closed positions thereof, the peripheral edge portions 118 and 120 meet in substantially mating relation, and the notches 122 and 124 are substantially aligned with each other and cooperate to define an aperture in the front wall of the housing 87 which is dimensioned for receiving the discharge assembly 89 therein.

The cooling assembly of the dispenser 12 is preferably similar to the cooling assembly 16 in the dispenser 10 and it includes a cold plate and a cold side exchanger which cooperate to define the bottom wall of the interior cavity which is formed in the housing 87.

The container member 88 preferably comprises a molded plastic container member having stiffening ribs 126, a bottom wall 128, a handle 130 and a mouth 132. The container member 88 and the housing 87 are preferably dimensioned so that the container member 88 is snugly receivable in the interior of the housing 87 as illustrated in FIG. 6 and so that the bottom wall 128 of the container member 88 is supported on the cold plate and the cold side exchanger therein. The handle 130 is preferably integrally formed on the forward end of the container member 88 adjacent the mouth 132.

The discharge assembly 89 is preferably similar to the discharge assembly 20, and it includes a neck portion 82 which extends outwardly from the mouth 132 and a valve portion 84 which is mounted in outwardly spaced relation to the mouth 132 on the neck portion 82. The valve portion 84 includes a terminal portion 86 which is manipulatable for discharging liquid from the container member 88.

For use of the dispenser 12, the housing 87 is moved to the open position thereof by hinging the doors 98 and 100 outwardly with respect to each other, and a container member 88 containing a beverage, such as water, is positioned in the housing 87 so that the bottom wall 128 of the container member 88 is supported on the cold plate and the cold side exchanger in the housing 87. Thereafter, the doors 98 and 100 are moved to the closed positions thereof; and as the peripheral edge portions 118 and 120 are moved together, the neck portion 82 is received in the notches 122 and 124. In this regard, when the doors 98 and 100 are fully closed, the notches 122 and 124 form an aperture in the front wall of the housing 87; and the valve portion 84 is disposed in front of the front wall of the housing 87. Further, the aperture which is formed by the notches 122 and 124 preferably has a dimension which is only slightly greater than the sectional dimension of the neck portion 82. In any event, the cooling assembly of the dispenser 12 is then connected to an electrical outlet, and once the beverage in container member 88 has been chilled, the chilled beverage can be dispensed therefrom by manipulating the discharge assembly 89.

It is seen therefore, that the instant invention provides an effective refrigerated dispenser construction which is adapted to be used for dispensing beverages, such as water, in household applications. The dispensers 10 and 12 are effectively adapted to be positioned in convenient locations, such as on kitchen counters or table tops. Further, the housings 14 and 87 are effectively adapted for use in combination with container members having discharge assemblies thereon so that the discharge assemblies can be manipulated from the exteriors of the housings 14 and 87. Accordingly, it is seen that for these reasons as well as the other reasons hereinabove set forth, the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A refrigerated dispenser for beverages comprising a substantially rigid container member for containing a beverage therein, discharge means communicating with the interior of said container member for discharging said beverage therefrom, a thermally insulated housing adapted and dimensioned for receiving said container member therein, said container member being received in said housing, and electrical cooling means in said housing communicating with said container member for cooling a beverage contained therein, said container member including a container member bottom wall, a dispensing wall which extends angularly forwardly and upwardly from said container member bottom wall and a container member front wall which extends upwardly from said container member dispensing wall in substantially perpendicular relation to said container member dispensing wall, said dispensing means including a tubular neck portion which extends outwardly from said container member dispensing wall and a valve portion on said neck portion in outwardly spaced relation to said container member dispensing wall, said housing comprising lower and upper housing sections, said lower housing section including an interior bottom wall, a pair of spaced substantially parallel upstanding housing lower sidewall portions, an upstanding housing rear wall portion and a housing lower front wall portion, said container member being received in said housing with said container member bottom wall received on said interior bottom wall and with said dispensing wall disposed adjacent said housing lower front wall portion, said housing lower front wall portion extending angularly forwardly and upwardly to a point adjacent said discharge means, said upper housing section including a housing intermediate front wall portion, a housing upper front wall portion, a pair of spaced substantially parallel upper side wall portions and a housing top wall, said upper housing section being hingeably attached to said lower housing section adjacent the upper end of said housing rear wall portion and being receivable in a closed position wherein said housing upper sidewall portions are received in mating engagement with said housing lower sidewall portions and said housing intermediate front wall portion is received in mating engagement with said housing lower front wall portion, at least one of said housing lower and intermediate front wall portions having a peripheral notch formed therein, said dispensing means neck portion extending through said notch, said housing intermediate front wall portion being disposed in substantially coplanar relation with said housing lower front wall portion and extending angularly forwardly and upwardly to a point adjacent the intersection between said dispensing wall and said container member front wall when said upper housing section is in the closed position thereof, said housing upper front wall portion extending upwardly in substantially perpendicular relation to said interior bottom wall when said upper housing section is in the closed position thereof.

* * * * *